United States Patent [19]

Choe

[11] Patent Number: 4,604,246

[45] Date of Patent: Aug. 5, 1986

[54] COMBINATION HUMIDIFIER/WATER DISTILLER

[75] Inventor: Pil Y. Choe, Dunellen, N.J.

[73] Assignee: Prodel Corp., Dunellen, N.J.

[21] Appl. No.: 685,033

[22] Filed: Dec. 21, 1984

[51] Int. Cl.[4] ..... B01F 3/04

[52] U.S. Cl. ..... 261/71; 165/60; 261/4; 261/81; 261/142; 261/156; 261/DIG. 46

[58] Field of Search ..... 261/4, 81, 141, 142, 261/78 A, 156, DIG. 46, 71; 203/10; 210/175; 165/60

[56] References Cited

U.S. PATENT DOCUMENTS

| | | | |
|---|---|---|---|
| 3,434,471 | 3/1969 | Liston | 261/142 X |
| 3,638,861 | 2/1972 | Nikel | 261/142 X |
| 3,776,530 | 12/1973 | Griffith et al. | 261/DIG. 46 |
| 3,824,985 | 7/1974 | Hetherington | 261/141 X |
| 3,952,181 | 4/1976 | Reed | 261/DIG. 46 |
| 4,031,171 | 6/1977 | Asao et al. | 261/81 X |
| 4,238,425 | 12/1980 | Matsuoka et al. | 261/81 |
| 4,257,389 | 3/1981 | Texidor et al. | 261/DIG. 46 |
| 4,257,989 | 3/1981 | Nishikawa | 261/81 X |
| 4,338,268 | 7/1982 | Wilkinson et al. | 261/156 X |

*Primary Examiner*—Richard L. Chiesa
*Attorney, Agent, or Firm*—Richard J. Rodrick

[57] ABSTRACT

A combination humidifier/water distiller apparatus comprises a container for holding tap water. A heater is provided for heating tap water in the container to a vaporized state. A condenser, positioned over the container, condenses the vaporized tap water into distilled water. A receptacle is positioned under the condenser for the collection of the distilled water. The receptacle includes a water track and valve for removing distilled water from the apparatus for other purposes. A nebulizer is included which converts the distilled water into a fine spray. A passage, associated with the nebulizer and the receptacle, supplies distilled water from the receptacle to the nebulizer so that distilled water is nebulized to a fine spray. The nebulizer includes a nozzle or the like for delivering the fine spray to the atmosphere to thereby humidify the surrounding air.

16 Claims, 11 Drawing Figures

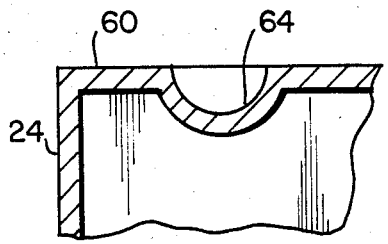
Fig. 4
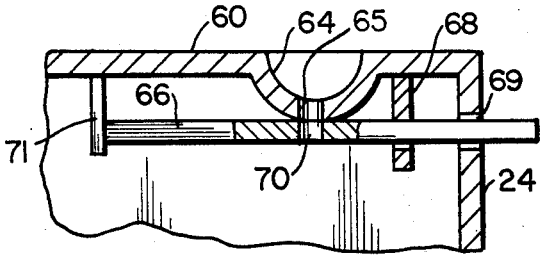
Fig. 5
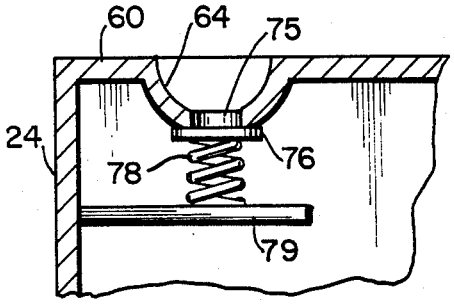
Fig. 7A
Fig. 6
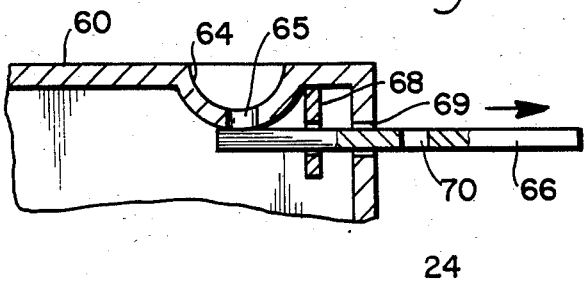
Fig. 7B
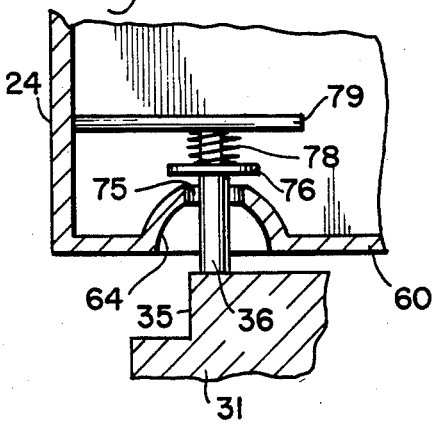

COMBINATION HUMIDIFIER/WATER DISTILLER

BACKGROUND OF THE INVENTION

1. Field of the Invention

The present invention relates to a humidifier and a water distiller, and more particularly, concerns a combination humidifier/water distiller apparatus which operates to simultaneously distill tap water while providing the distilled water to the humidifier for use therewith.

2. Description of the Prior Art

Humidifiers or nebulizers are well-known and have been used for a variety of purposes. In particular, humidifiers are used in the home, office and elsewhere to humidify the air by increasing its moisture or water content. In situations where the surrounding air is relatively dry, humidifiers have been found to be quite beneficial in supplying additional moisture to reduce the dryness. Some people who have breathing difficulties or are affected by low humidity in a dry environment often times rely upon a humidifier to alleviate these difficulties. A particularly well-known use of humidifiers is its placement in a room with a child who may be experiencing breathing difficulties as a result of a cold, flu or the like. There are, of course, other reasons and uses for humidifiers.

For the most part, people who use humidifiers in the home or for non-professional reasons rely on tap water to start their humidifers. Tap water includes many minerals or other impurities which affect the performance and life of the humidifier components. For instance, various salts, metals and minerals in ordinary tap water contribute to the corrosion of some parts of typical humidifiers. As a result, the effective life of the humidifier may be shortened if such corrosion occurs. On the other hand, use of distilled water in a humidifier would avoid many of these problems since the distilled water has been purified and does not contain those distructive elements normally found in tap water. The problem that arises, however, is that distilled water is not always on hand for use, whereas tap water is always conveniently available. Therefore, for convenience purposes, tap water often times is the water of choice. If distilled water could be conveniently made available for the humidifier, reliance on tap water would not be so predominant. Accordingly, it is one of the purposes of the present invention to provide a combination humidifier/-water distiller that starts with tap water, purifies or distills that water, and then makes the distilled water available to the humidifier portion of the apparatus.

Water distillers are known and available for purifying tap water. By converting tap water to steam or vapor, and then back again to water, chemicals and impurities are removed from the water. Further, the distillation process kills microorganisms. Distilled water is not only beneficial for purposes of the humidifier, as described above, but has other independent uses. For example, distilled water may be consumed for drinking purposes and used in circumstances where impurities, minerals or chemicals might be problematical. Home water distillers are available which take tap water, heat the water until it vaporizes, and collect the condensated water which normally is distilled as water droplets.

It is one of the objects of the present invention to provide a combination humidifier/water distiller which takes ordinary tap water and distills it. This distilled water may then be tapped or drained for other purposes, or may be supplied directly to the humidifier aspect of the invention for humidification purposes.

SUMMARY OF THE INVENTION

A combination humidifier/water distiller apparatus comprises means for distilling tap water into distilled water. Means collects the distilled water and selectively stores same in a receptacle, drains the distilled water from the apparatus or delivers the distilled water to be nebulized. Nebulizer means converts the distilled water into a fine spray to be delivered to the atmosphere to thereby humidify the surrounding air.

In a preferred embodiment of the present invention, the combination humidifier/water distiller apparatus includes a container for holding tap water. A heater is provided for heating tap water in the container to a vaporized state. A condenser, preferably positioned over the container, condenses the vaporized tap water into distilled water. A receptacle, preferably positioned under the condenser, collects the distilled water. The receptacle includes means for removing the distilled water from the apparatus. Nebulizer means converts distilled water (or other liquids, if so used) into a fine spray. Passage means associated with the nebulizer means and the receptacle supplies distilled water from the receptacle to the nebulizer means so that distilled water is nebulized to the fine spray. The nebulizer means includes means for delivering the fine spray to the atmosphere to thereby humidify the surrounding air.

In accordance with the principles of the present invention, a water distiller has been combined with a humidifier as an integrated unit. The present invention thereby provides the convenience for the user to start with tap water, and by virtue of the distillation process, have distilled water made available for the humidifier. The provision of distilled water to the humidifier is automatic in the present invention, so that a user need not have an independent supply of distilled water on hand for use. Further, distilled water may be collected in the receptacle for other purposes or may be immediately drained from the apparatus if instant use of distilled water is expected. The feature of providing simultaneous operation of water distillation and humidification is not only convenient for sake of the user, but offers advantages as well. For example, the user does not have to pay the additional expense of purchasing distilled water for use in the humidifier. In addition, since the humidifier will be using distilled water in its operation, no impurities are involved which would otherwise corrode the working components of the humidifier or reduce its effective life of operation. The combination humidifier/water distiller may be packaged in a convenient form so that all of the advantageous features described above may be achieved.

BRIEF DESCRIPTION OF THE DRAWINGS

FIG. 4 is an enlarged cross-sectional view of the upper water track taken along line 4—4 of FIG. 2;

FIG. 5 is an enlarged cross-sectional view of the valve mechanism associated with the first water track taken along line 5—5 of FIG. 2 illustrated in the open position for allowing distilled water into the interior of the receptacle;

FIG. 6 is an enlarged cross-sectional view of the valve mechanism of FIG. 5 illustrated in the closed position for draining of distilled water without entering the receptacle;

FIG. 7*a* is an enlarged cross-sectional view of the valve mechanism associated with the first water track for draining distilled water out of the receptacle taken along line 7—7 of FIG. 2;

FIG. 7*b* is an enlarged cross-sectional view of the valve mechanism of FIG. 7*a* illustrating the valve in the open position when the receptacle has been turned over for draining distilled water for the humidifier;

DETAILED DESCRIPTION

Figure 1:
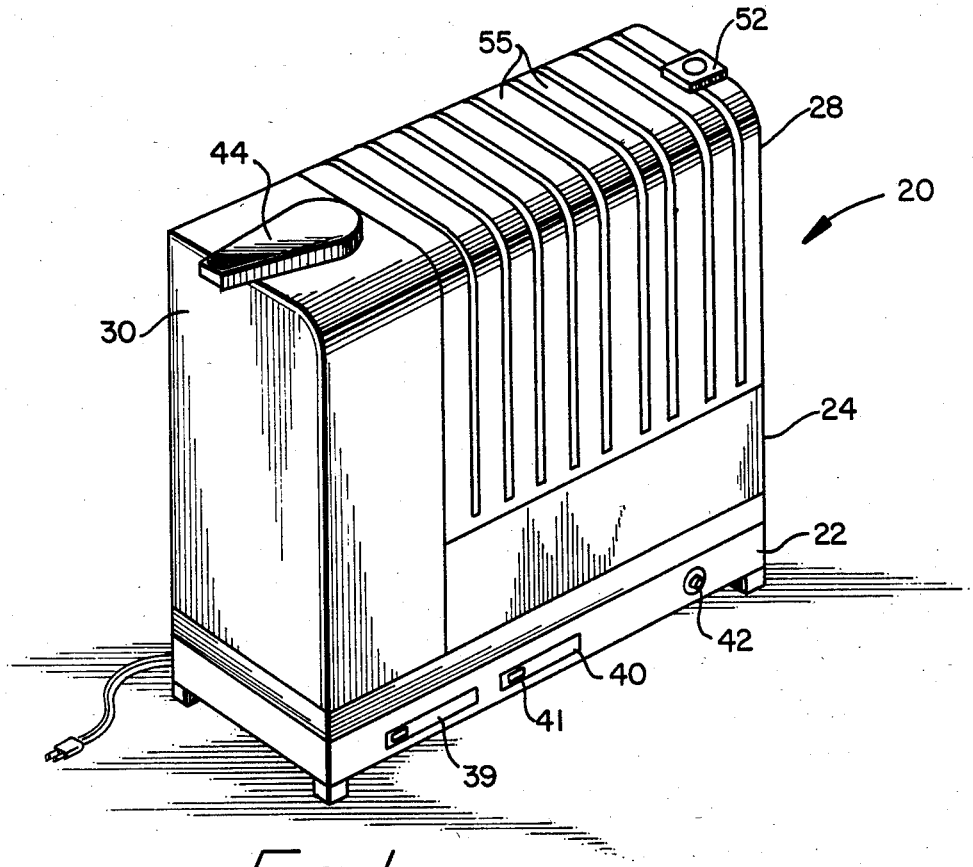
FIG. 1 is a perspective view of the preferred combination humidifier/water distiller of the present invention.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Figure 2:
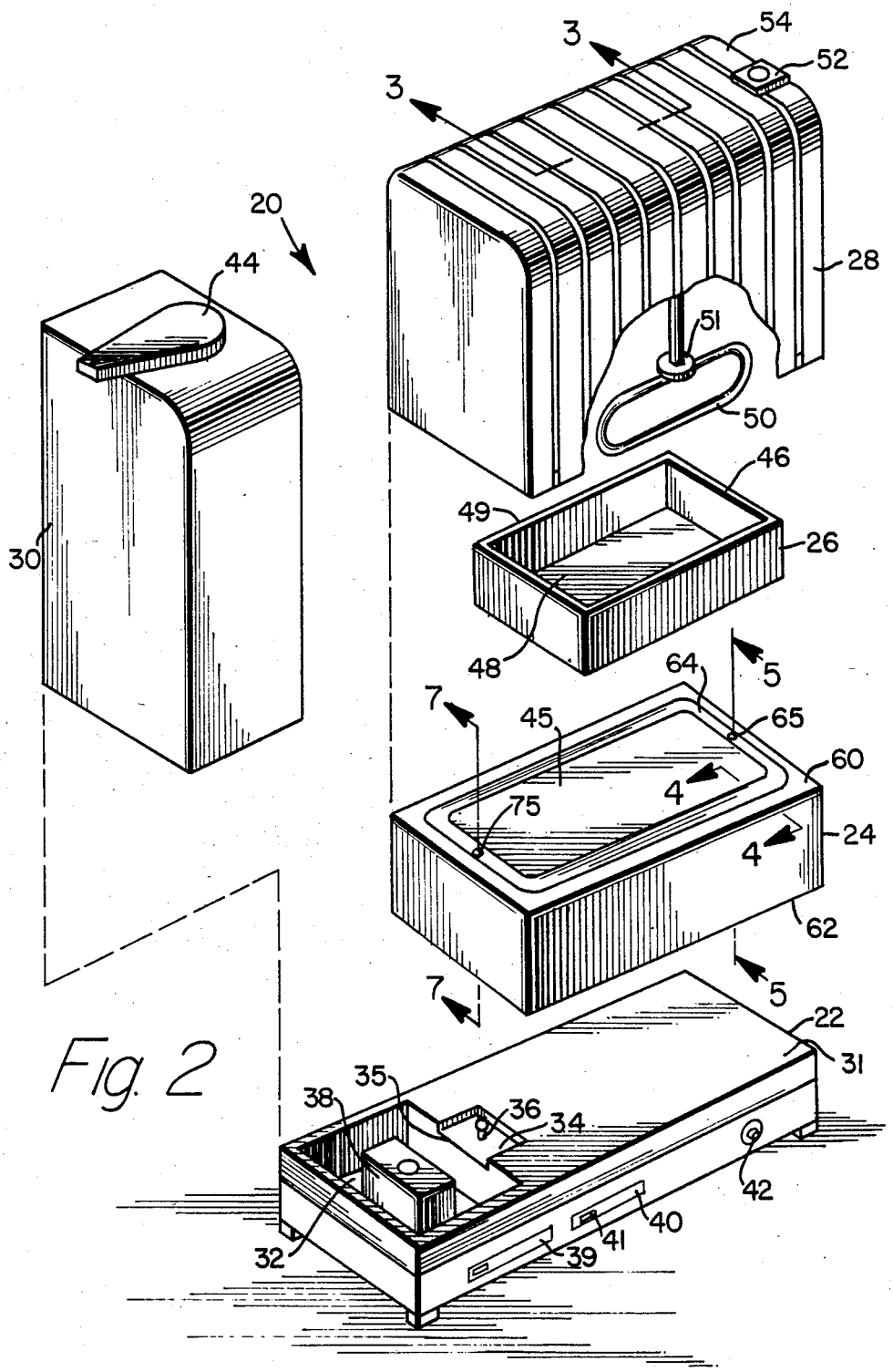
FIG. 2 is a exploded, perspective view of the major components of the preferred humidifier/water distiller of FIG. 1.

Referring now to the drawings, and FIGS. 1 and 2 in particular, there is illustrated a combination humidifer/-water distiller apparatus 20. This apparatus includes five major components which are illustrated in the assembled form in FIG. 1 and in a dissembled, exploded appearance in FIG. 2. These five major components are a base unit 22, a liquid receptacle 24, a water container 26, a condenser 28 and a vapor chamber 30 for humidification purposes. As viewed in FIGS. 1 and 2, the right side of apparatus 20 contains the water distillation components, whereas the left side of the apparatus includes the humidifier components. In the assembled form as seen in FIG. 1, a unitized, compact module, of pleasing appearance and functional construction, is most representative of the present invention.

Turning more specificically now to FIG. 2, base unit 22 serves as a supporting structure and includes a support surface 31 for receptacle 24. A recessed cavity 32 is provided in a portion of base unit 22 for holding water, preferably distilled, for nebulization purposes. A recess 34 is formed in support surface 31 with an open face 35 communicating with cavity 32. Upstanding from recess 34 is a pin 36, which extends into the plane above surface 31. The purpose of pin 36 and recess 34 will be described more fully hereinafter.

Included within cavity 32 is a nebulizer device 38 which is capable of converting liquid such as distilled water into a fine spray for humidification purposes. Nebulizers, such as unit 38, are quite well-known and the means to convert liquid to a fine spray is well within the skill of an artisan in this field.

In addition to serving as support purposes for the water distillation features and holding the humidifier elements, base unit 22 also includes the various controls for the operation of the apparatus. The electrical circuitry is maintained within base unit 22 and includes such features as a humidistat control 39 and mist or spray control 40. An on/off control 41 for the humidifier is also provided, as well as an on/off control 42 for the water distiller. If nebulizer unit 38 relies upon ultrasonic frequency for operation, the elements to achieve such operation are also included within base unit 22. It is preferred that base unit 22 be fabricated of lightweight material, compatible with convenient use for home operation.

As seen in FIGS. 1 and 2, vapor chamber 30 covers cavity 32 and nebulizer unit 38. When water, preferably distilled, is converted to a fine spray within the vapor chamber, the spray exits through nozzle 44 and is delivered to the atmosphere to thereby humidify the surrounding air. Nozzle 44 may include a baffle or other regulatory elements (not shown) for controlling the quantity of spray provided to the atmosphere.

Before pointing out the detailed elements of receptacle 24, container 26 and condenser 28, the general orientation of these components should be mentioned. Receptacle 24, which is positionable in two different orientations as will be explained, rests directly on support surface 31 of the base unit. Container 26 is positioned directly on receptacle 24 within a central portion 45 thereof. Condenser 28 then fits over container 26 so that the walls of the condenser rest atop the upper surface of receptacle 24. The assembled structure is clearly illustrated in FIG. 1.

Referring first to container 26, in its simplified form, it is merely a vessel with side walls 46, a bottom wall 48 and an open top end 49. Container 26 is preferably rectangularly shaped and is adapted to hold a sufficient quantity of water for sustained operation of the apparatus. The user is able to carry container 26 and fill same with tap water for operation of the instant apparatus.

Condenser 28 preferably includes a heater element 50 mounted within its interior. When the condenser covers container 26 with tap water therein, heater element 50 extends into the container and is immersible in the tap water. The heater is sufficiently designed to heat tap water in the container to a vaporized state. When the water level in container 26 is low, a sensor 51, preferably positioned on or near the heater, provides a signal to the exteriorly positioned indicator 52. The electrical circuitry for heater 50, sensor 51 and indicator 52 may be included within base unit 22.

Figure 3:
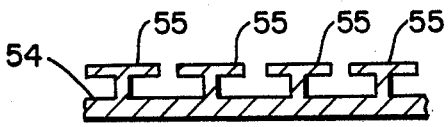
FIG. 3 is an enlarged cross-sectional view of the cooling fins of the condenser taken along line 3—3 of FIG. 2.

It is the purpose of condenser 28 to convert vapor or steam back to water again. To this end, when tap water from the container evaporates, and rises as steam, the steam collects on the interior walls of condenser 28. As cooling occurs, and the water is distilled, the distilled water is adapted to drop, by gravity, downwardly toward receptacle 24, which is positioned under the condenser. To facilitate the cooling function of condenser 28, the exterior surface 54 of the condenser is preferably formed with a plurality of cooling fins 55 which significantly increase the surface area of the condenser exposed to the atmosphere. These fins are more clearly seen by briefly referring to FIG. 3. As alluded to above, water which condenses on the inside of condenser 28 drops onto receptacle 24, the details of which will now be described.

Receptacle 24 is preferably an enclosed housing and may be in the shape of a box or rectangular prism generally having the dimensions of base unit 22. As can be seen in FIG. 2, receptacle 24 includes two opposed substantially horizontal surfaces, 60 and 62 respectively. In the embodiment illustrated in FIG. 2, surface 60 is seen as an upper surface, whereas surface 62 is seen as a lower surface. Surface 60 includes a first recessed water track 64 extending around the receptacle. FIG. 4 illustrates the nature of recessed water track 64. Water track 64 is spaced somewhat inwardly from the walls of receptacle 24, but container 26 should not cover or block the water track when the apparatus is assembled for operation.

Associated with water track 64, and surface 60 of the receptacle, are two valve mechanisms. The first valve mechanism is illustrated in FIGS. 5 and 6, taken in conjunction with FIG. 2. It can be seen that an aperture 65 extends through recessed water track 64. A manually operative member 66 is mounted by virtue of a bracket 68 within receptacle 24. A small hole 69 in the side of receptacle 24 pemits member 66 to slide therethrough. A hole 70 extends through member 66 and is alignable with aperture 65 in the recessed water track. When member 66 is slid inwardly so that it abuts against stop 71, hole 70 and aperture 65 are in alignment. Thus, distilled water from the interior of condenser 28 which drips into recessed water track 64 is now allowed to pass through aperture 65 and opening 70 so that the distilled water is collected in the receptacle. In order to prevent distilled water from passing into the receptacle, valve member 66 is slid outwardly through hole 69 as illustrated in FIG. 6. In this arrangement, hole 70 in member 66 is moved outside of the receptacle. If member 66 is formed in the shape of a scoop or the like, water in recessed water track 64 passes through aperture 65 and is collected in valve member 66. The water then passes outwardly, along valve member 66, and may be collected outside of the receptacle when the water drips through hole 70. Thus, valve member 66 serves as a tap to drain distilled water from the apparatus without entering the receptacle.

The other valve mechanism associated with recessed water track 64 is preferably on the other side of the receptacle facing cavity 32 for the nebulizer. In this arrangement, a drain hole 75 extends through the recessed water track and is normally maintained in the closed position by a plate or valve seat 76 positioned directly beneath hole 75. A spring 78 mounted on a platform 79 is provided to bias the valve seat 76 against hole 75. This arrangement is clearly illustrated in FIG. *7a*.

In order to provide distilled water to the nebulizer unit, receptacle 24 must be turned upside down from the orientation illustrated in FIG. 2. This reversed position of the receptacle is illustrated in FIG. *7b*, highlighting the operation of the valve mechanism previously described with respect to FIG. *7a*. It can be seen in FIG. *7b* that the reversal of receptacle 24 causes pin 36 to pass through drain hole 75 and engage valve seat 76. The weight of the receptacle, in conjunction with the pin, causes valve seat 76 to move away from drain hole 75 thereby opening same. Distilled water within the receptacle is then allowed to empty through drain hole 75 and flow across open face 35 and into cavity 32 for nebulization purposes.

Figure 8:
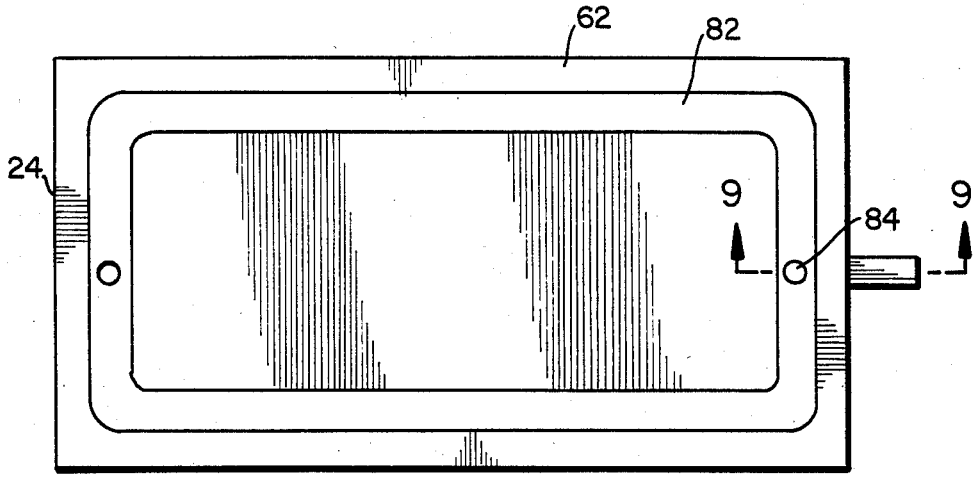
FIG. 8 is a plan view of the bottom surface of the receptacle illustrating the second water track.
Figure 9:
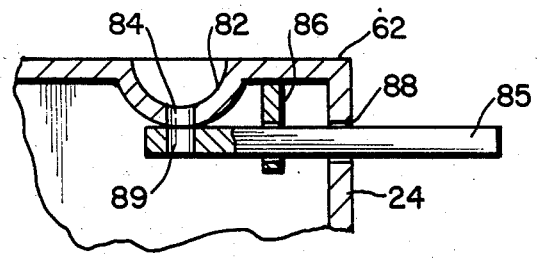
FIG. 9 is an enlarged cross-sectional view of the valve mechanism associated with the second water track taken along line 9—9 of FIG. 8.
Figure 10:
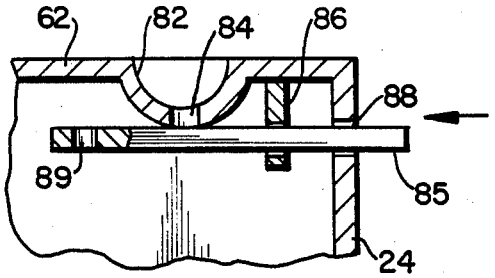
FIG. 10 is an enlarged cross-sectional view of the valve mechanism of FIG. 9 illustrated in the closed position to prevent water from entering the receptacle.

FIGS. 8, 9 and 10 illustrate second horizontal surface 62 of receptacle 24 which will be facing upwardly when it is intended to drain distilled water from the receptacle for passage to the nebulizer. In order to allow distilled water to be fed to the nebulizer simultaneously with the distillation process, surface 62 also includes a recessed water track 82 extending around the periphery thereof. Track 82 is similar in virtually all respects to first recessed water track on the other side of the receptacle. When surface 62 is facing upwardly, distilled water from the condensation process within condenser 28 falls into recessed track 82. So that distilled water may be collected inside the receptacle, a valve mechanism is also associated with recessed track 82. To this end, an opening 84 extends through recessed water track 82. Directly beneath opening 84 is a slidable valve member 85 held in position within the receptacle by an appropriate bracket 86, and which is slidable through a side port 88. A sealing gasket or the like may be associated with side port 88 so as to prevent leakage of water from the receptacle when the receptacle is turned the other way. Slidable valve member 85 includes a hole 89 which is alignable with opening 84. Thus, in the orientations seen in FIG. 9, distilled water which drops into track 82, passes through opening 84 and aligned hole 89 and is collected inside the receptacle.

FIG. 10 illustrates the closing of opening 84 to prevent distilled water from entering the receptacle. Slidable valve member 85 is slid inwardly so that hole 89 becomes misaligned with opening 84. Once again, an appropriate sealing surface or gasket on slidable valve member 85 would facilitate the closure of opening 84 so that water may not enter the interior of the receptacle.

It is appreciated that while various valve mechanisms have been illustrated and described herein, they are merely meant to be exemplary and not limitative of the invention. Various valve mechanisms and designs, sufficient to achieve the features of the valves described herein, also fall within the purview of the present invention. In addition, the various shapes and configurations illustrated and described herein are further meant to be illustrative, not limitative, of the present invention.

Thus, the present invention provides a combination humidifier/water distiller apparatus that conveniently distills water and automatically makes it available for humidification purposes. This simultaneous water distillation and humidification feature eliminates the need to have a separate supply of distilled water on hand, which is the case with present day humidifiers. Moreover, the present invention allows distilled water to be tapped for other uses or for storage purposes.

What is claimed is:

1. A combination humidifier/water distiller apparatus comprising:

a container for holding tap water;

a heater for heating tap water in the container to a vaporized state;

a condenser for the condensation of vaporized tap water into distilled water;

a receptacle for the collection of said distilled water and including means for removing said distilled water therefrom;

nebulizer means for converting liquid into a fine spray;

said container, heater, condenser, receptacle and nebulizer means assembled together in an integrated, utilized, compact module; and passage means associated with said nebulizer means and said receptacle for the supply of distilled water from said receptacle to said nebulizer means so that distilled water is nebulized to the fine spray, said nebulizer means including means for delivering said fine spray to the atmosphere to thereby humidify the surrounding air.

2. The apparatus of claim 1 wherein said heater is mounted inside said condenser.

3. The apparatus of claim 2 wherein said heater is mounted to extend into said container whereby, when tap water is in said container, said heater is immersible in said tap water.

4. The apparatus of claim 1 which further includes a sensor and indicator for signaling that water in said container is low.

5. The apparatus of claim 1 wherein said condenser includes a plurality of fins on its outside surface to facilitate cooling inside the condenser for the condensation of vaporized water into distilled water.

6. The apparatus of claim 1 wherein said receptacle is positioned directly under said condensor so that condensed, distilled water is adapted to drop, by gravity, into said receptacle.

7. A combination humidifier/water distiller apparatus comprising:

a container for holding tap water;

a heater for heating tap water in the container to a vaporized state;

a condenser for the condensation of vaporized tap water into distilled water;

a receptacle for the collection of said distilled water and including means for removing said distilled water therefrom, said receptacle including an enclosed housing which has access means for allowing the passage of distilled water into the interior of said housing, wherein said housing includes a first recessed water track in one surface of the housing, said access means being associated with said track so that distilled water which is collected in said track passes through said access means into said receptacle;

nebulizer means for converting liquid into a fine spray; and passage means associated with said nebulizer means and said receptacle for the supply of distilled water from said receptacle to said nebulizer means so that distilled water is nebulized to the fine spray, said nebulizer means including means for delivering said fine spray to the atmosphere to thereby humidify the surrounding air.

8. The apparatus of claim 7 wherein said access means is an aperture.

9. The apparatus of claim 8 which further includes a first manually operative valve to selectively close said aperture to prevent distilled water from passing into said receptacle.

10. The apparatus of claim 9 wherein said means for removing said distilled water includes a tap associated with said valve, so that when said aperture is closed by said valve, distilled water drains from said track without entering said receptacle.

11. The apparatus of claim 7 wherein said first water track includes a drain hole therethrough and operative closure means for normally maintaining said hole closed when said closure means is in a first position and for allowing said hole to be open when said closure means is in a second position.

12. The apparatus of claim 11 wherein said closure means includes a spring-loaded member for normally maintaining said drain hole in a closed position.

13. The apparatus of claim 11 wherein said housing further includes a second recessed water track in a second surface opposed from said one surface, said second water track including an opening therethrough for permitting distilled water to pass into the receptacle, and a manually operative valve to selectively close said opening to prevent distilled water from passing into said receptacle.

14. The apparatus of claim 13 wherein said receptacle is selectively positioned so that said first water track faces downwardly and said second water track upwardly so that distilled water is collected in said receptacle by passing through the opening in said second track, said apparatus including an upstanding pin depressed against said operative closure means to maintain said drain hole in an open condition, said drain hole cooperating with said passage means to supply distilled water to said nebulizer means.

15. The apparatus of claim 1 wherein said nebulizer means includes means for controlling the quantity of spray provided to the atmosphere.

16. A combination humidifier/water distiller apparatus comprising:

a container for holding tap water;

a heater immersible in said tap water for heating same to a vaporized state;

a condenser positioned over said container including a plurality of cooling fins thereon for the condensation of vaporized tap water into distilled water;

a movable receptacle positioned under said condenser for the collection of distilled water, said receptacle including a first water track positioned to collect said distilled water when the receptacle is in a first position, said first water track including valve means to selectively permit said distilled water to enter the interior of the receptacle for storage or to drain distilled water from the first track without entering the receptacle, said receptacle including a second water track positioned to collect said distilled water when the receptacle is in a second position, said second water track including an opening to permit distilled water to enter the interior of the receptacle and operative valve means actuated by means in the apparatus for opening the valve means in the second track to permit distilled water to pass out of said receptacle; and nebulizer means for converting distilled water into a fine spray, said apparatus including passage means from the operative valve means for said second track to the nebulizer means so that distilled water may be delivered to said nebulizer means, said nebulizer means including means for delivering said fine spray to the atmosphere to thereby humidify the surrounding air.

* * * * *